US009335708B1

(12) United States Patent
Makita et al.

(10) Patent No.: US 9,335,708 B1
(45) Date of Patent: May 10, 2016

(54) IMAGING UNIT AND IMAGE FORMING APPARATUS

(71) Applicant: FUJI XEROX CO., LTD., Tokyo (JP)

(72) Inventors: Shota Makita, Kanagawa (JP); Ryuji Hattori, Kanagawa (JP); Kazuya Nishimura, Kanagawa (JP); Katsuyuki Nishizawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/829,304

(22) Filed: Aug. 18, 2015

(30) Foreign Application Priority Data

Feb. 6, 2015 (JP) ..... 2015-022177

(51) Int. Cl.
*G03G 15/00* (2006.01)
*G03G 21/18* (2006.01)

(52) U.S. Cl.
CPC ..... *G03G 15/757* (2013.01); *G03G 21/1821* (2013.01); *G03G 21/1825* (2013.01); *G03G 21/1857* (2013.01); *G03G 2221/1861* (2013.01)

(58) Field of Classification Search
CPC ..... G03G 15/757; G03G 21/1821; G03G 21/1825; G03G 21/1857; G03G 2221/1861
See application file for complete search history.

(56) References Cited

U.S. PATENT DOCUMENTS

2009/0297208 A1* 12/2009 Suzuki ..... G03G 21/1825 399/109
2012/0045247 A1* 2/2012 Lewis ..... G03G 15/757 399/167
2012/0275815 A1* 11/2012 Koyama ..... G03G 21/1825 399/102
2014/0072339 A1* 3/2014 Munetsugu ..... G03G 21/1825 399/113
2014/0153968 A1* 6/2014 Huck ..... G03G 15/757 399/167
2014/0314444 A1* 10/2014 Ogino ..... G03G 15/0813 399/111
2015/0003867 A1* 1/2015 Koyama ..... G03G 21/1821 399/113

FOREIGN PATENT DOCUMENTS

JP 04-116577 A 4/1992
JP 08-286453 A 11/1996

* cited by examiner

*Primary Examiner* — Rodney Bonnette
(74) *Attorney, Agent, or Firm* — Oliff PLC

(57) ABSTRACT

An imaging unit includes a support body; a photoconductor supported by the support body; a developing device supported by the support body to swing about a pivot arranged at a pivot portion, and including a development roller having a gap holding member that contacts a portion of the photoconductor; and a driven coupling member provided at a first end portion of the development roller, and removably coupled to a driving coupling member to which a rotational power is transmitted. The pivot portion is arranged so that the developing device swings toward the photoconductor by self weight. The driving or driven coupling member has at least three protruding portions that restrict rotation of the developing device when the members are coupled. The development roller rotates in a generation direction of an action that causes the developing device to swing toward the photoconductor when receives the rotational power and is rotationally driven.

3 Claims, 13 Drawing Sheets

3 CLAWS
(ROTATION AT 3 POINTS A1, A2, AND A3)

2 CLAWS
(ROTATION AT 2 POINTS A4 AND A5)

IMAGING UNIT AND IMAGE FORMING APPARATUS

CROSS-REFERENCE TO RELATED APPLICATIONS

This application is based on and claims priority under 35 USC 119 from Japanese Patent Application No. 2015-022177 filed Feb. 6, 2015.

BACKGROUND

The present invention relates to an imaging unit and an image forming apparatus.

SUMMARY

According to an aspect of the invention, there is provided an imaging unit including a support body; a photoconductor supported by the support body; a developing device supported by the support body to be able to swing about a pivot arranged at a pivot portion, and including a development roller having a gap holding member that contacts a portion of the photoconductor and holds a gap between the development roller and the photoconductor; and a driven coupling member that is provided at a first end portion of the development roller, is coupled in a removably inserted manner to a driving coupling member to which a rotational power is transmitted, and transmits the rotational power to the development roller. The pivot portion is arranged at a position at which the developing device swings in a direction toward the photoconductor by a self weight of the developing device. The driving coupling member or the driven coupling member is a member in a form having at least three protruding portions that restrict movement of the developing device in a rotation direction when the driving coupling member and the driven coupling member are coupled. The development roller rotates in a direction in which an action that causes the developing device to swing in the direction toward the photoconductor is generated when the development roller receives the rotational power from the driving coupling member and is rotationally driven.

BRIEF DESCRIPTION OF THE DRAWINGS

Exemplary embodiments of the present invention will be described in detail based on the following figures, wherein.

DETAILED DESCRIPTION

Exemplary embodiments for implementing the invention (hereinafter, merely referred to as "exemplary embodiments") are described below with reference to the accompanying drawings.

First Exemplary Embodiment

Figure 1:
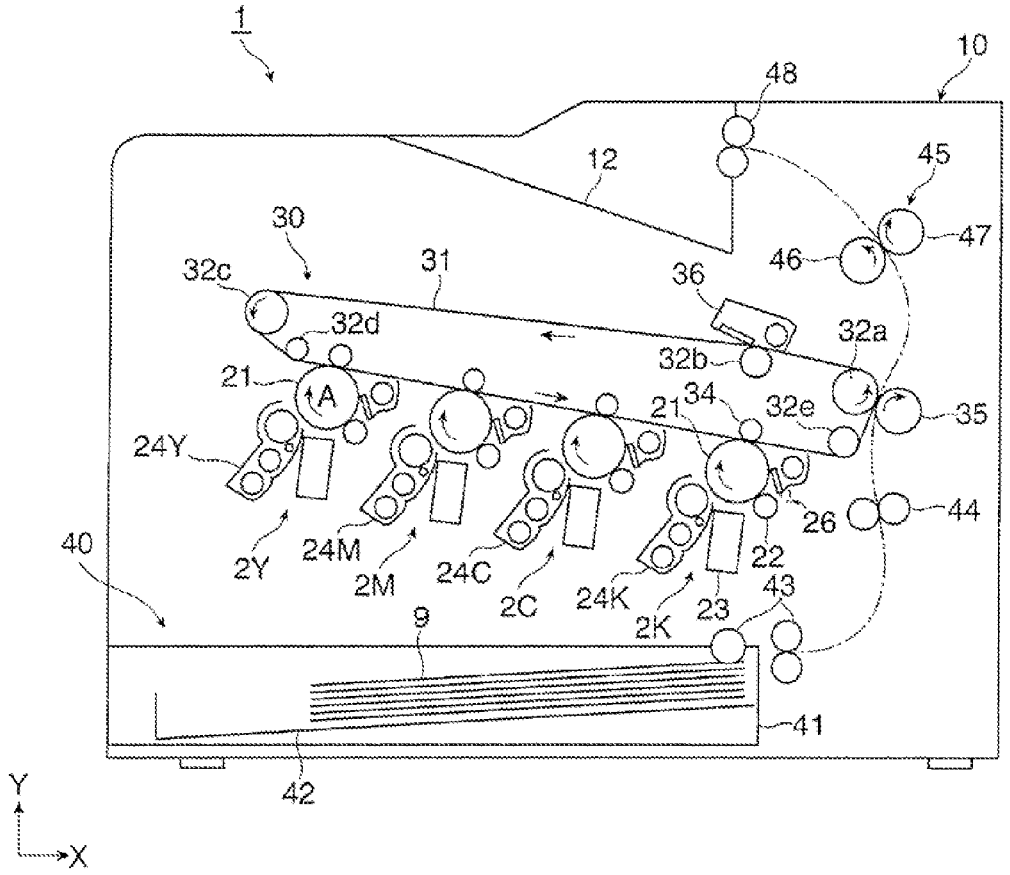
FIG. 1 is a schematic explanatory view showing a major portion of an image forming apparatus including an imaging unit according to a first exemplary embodiment.
Figure 2:
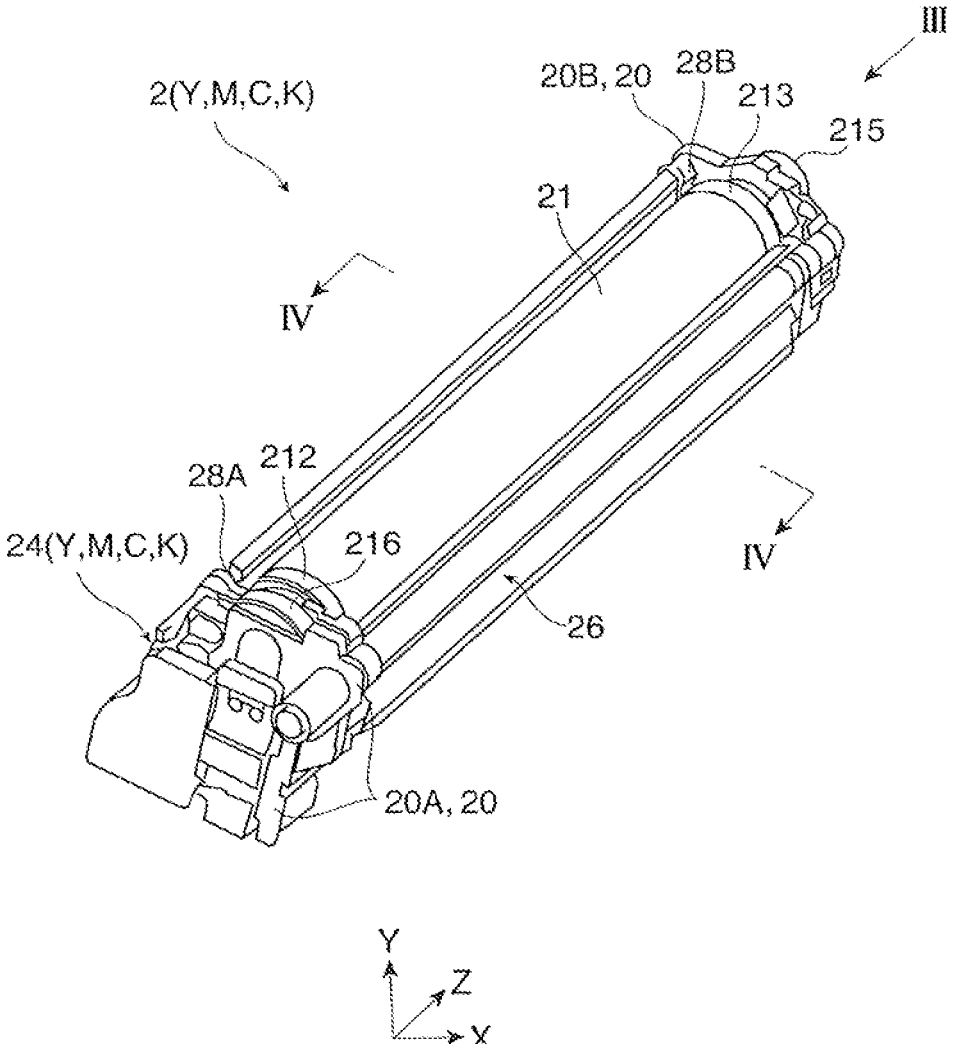
FIG. 2 is a perspective view showing the entirety of the imaging unit in FIG. 1.

FIGS. 1 and 2 illustrate an image forming apparatus 1 including an imaging unit 2 according to a first exemplary embodiment. FIG. 1 illustrates the overview of the image forming apparatus 1, and FIG. 2 illustrates the external appearance of the imaging unit 2. Arrows indicated by reference signs X, Y, and Z in the drawings represent (directions of) rectangular coordinate axes indicating the width, height, and depth of the expected three-dimensional space in the drawings.

General Configuration of Image Forming Apparatus

The image forming apparatus 1 forms an image configured of a developer on a recording sheet 9 being an example of a recording medium. For example, the image forming apparatus 1 is configured as a printer that forms an image by receiving image information input from an external device such as an information terminal or the like.

The image forming apparatus 1 includes a housing 10 entirely having a box-shaped external appearance. As shown in FIG. 1, the imaging unit 2 that forms a toner image configured of a toner serving as a developer, an intermediate transfer device 30 that relays and transports the toner image formed by the imaging unit 2 and then second transfers the toner image on the recording sheet 9, a sheet feed device 40 that houses the recording sheet 9 to be supplied to a second transfer position of the intermediate transfer device 30 and sends out the recording sheet 9, and a fixing device 45 that fixes the toner image second transferred by the intermediate transfer device 30 to the recording sheet 9. An output housing portion 12 is formed at an upper surface portion of the housing 10. The output housing portion 12 houses the recording sheet 9 with the image fixed and hence formed in a stacked manner after the recording sheet 9 is output. A dotted-chain line in FIG. 1 is a major transport path for the recording sheet 9 in the housing 10.

The imaging unit 2 according to the first exemplary embodiment is configured of four imaging units 2Y, 2M, 2C, and 2K that individually respectively form four-color developer (toner) images of yellow (Y), magenta (M), cyan (C), and black (K). Also, these imaging units 2 (Y, M, C, K) are arranged in the inner space of the housing 10 in order of black, cyan, magenta, and then yellow so that their positions gradually become higher in that order (inclined state).

The four imaging units 2 (Y, M, C, K) each include a photoconductor drum 21 that is rotationally driven in a direction indicated by arrow A; a charging device 22 in a roller shape or other shape that electrically charges the outer peripheral surface serving as an image formation region of the photoconductor drum 21 to a predetermined potential; an exposure device 23 that irradiates the outer peripheral surface of the electrically charged photoconductor drum 21 to light with one of respective color components divided in accordance with image information and forms an electrostatic latent image of the color component; a developing device 24 (Y, M, C, K) that develops the electrostatic latent image with a toner of the color component and visualizes the electrostatic latent image as a toner image of the corresponding color (Y, M, C, K); and a drum cleaning device 26 that removes an unnecessary substance such as a toner remaining on the outer peripheral surface of the photoconductor drum 21 after the toner image on the photoconductor drum 21 is first transferred on (an intermediate transfer belt 31 of) the intermediate transfer device 30 and cleans up the photoconductor drum 21.

Also, in each imaging unit 2 (Y, M, C, K), the photoconductor drum 21, the charging device 22, the developing device 24 (Y, M, C, K), and the drum cleaning device 26 are supported by a common support frame 20 (see FIG. 2) and hence are integrated, and entirely have a unit structure that is removably attached to a corresponding mount portion (not shown) provided at the housing 10 of the image forming apparatus 1. Also, the imaging unit 2 (Y, M, C, K) is mounted to the mount portion of the image forming apparatus 1 and used in a posture that a side at which the developing device 24 is arranged with respect to the photoconductor drum 21 as the center is slightly elevated upward and the entire unit is slightly inclined. An LED array in a line form in which plural light-emitting diodes (LEDs) and various optical components are combined is applied to the exposure device 23. The exposure device 23 is previously arranged at the housing 10 of the image forming apparatus 1. Also, this exposure device 23 is arranged within an arrangement space 230 (see FIGS. 3 and 4) formed between the charging device 22 and the developing device 24 in the imaging unit 2 when the imaging unit 2 is mounted to the mount portion of the image forming apparatus 1.

The details of the imaging units 2 (Y, M, C, K) are described later.

In each imaging unit 2 (Y, M, C, K), for example, when a request for an image forming operation is received, the charging device 22 electrically charges the outer peripheral surface of the rotationally driven photoconductor drum 21 to a predetermined potential, and then the exposure device 23 irradiates the electrically charged outer peripheral surface of the photoconductor drum 21 to light corresponding to an image signal of a corresponding color component and hence forms an electrostatic latent image of the color component. Then, the corresponding developing device 24 (Y, M, C, K) develops the electrostatic latent image of the color component formed on the outer peripheral surface of the photoconductor drum 21 with a toner of corresponding one of the four colors (Y, M, C, K). Thus toner images of the four colors are formed on the photoconductor drum 21.

The intermediate transfer device 30 is arranged to be slightly inclined toward the upper side of the four imaging units 2 (Y, M, C, K). The intermediate transfer device 30 includes the endless intermediate transfer belt 31 that allows the toner images formed on the photoconductor drums 21 of the imaging units 2 (Y, M, C, K) to be transferred and held thereon by an electrostatic effect; plural support rollers 32*a* to 32*e* that support the intermediate transfer belt 31 so that the intermediate transfer belt 31 successively passes through respective first transfer positions of the imaging units 2 (Y, M, C, K) and rotates; first transfer devices 34 in roller shapes or other shapes that are arranged inside the intermediate transfer belt 31 and first transfer the toner images respectively formed on the photoconductor drums 21 of the imaging units 2 (Y, M, C, K) onto the outer peripheral surface of the intermediate transfer belt 31; a second transfer device 35 in a roller shape or other shape that second transfers the toner images first transferred on the intermediate transfer belt 31 onto a recording sheet 9; and a belt cleaning device 36 that removes an unnecessary substance such as a toner remaining on the outer peripheral surface of the intermediate transfer belt 31 after the second transfer and cleans up the intermediate transfer belt 31.

The support roller 32*a* is configured as a driving roller and a second transfer backup roller, the support roller 32*c* is configured as a tension applying roller, the support rollers 32*d* and 32*e* are configured as surface shaping rollers, and the support roller 32*b* is configured as a cleaning backup roller.

The sheet feed device 40 is arranged below the four imaging units 2 (Y, M, C, K). The sheet feed device 40 is attached to the housing 10 to be able to be pulled out from the housing 10, and includes a sheet housing body 41 that houses recording sheets 9 of desirable size and kind in a stacked manner on a mount plate 42, and a sending device 43 that sends out the recording sheets 9 one by one from the sheet housing body 41.

For example, in an image forming operation, this sheet feed device 40 sends out predetermined recording sheets 9 one by one from the sheet housing body 41 by the sending device 43. The recording sheet 9 sent out from the sheet feed device 40 is moved along a transport path indicated by a dotted-chain line, and is finally sent to the second transfer position of the intermediate transfer device 30 (between the intermediate transfer belt 31 and the second transfer device 35) in synchronization with a second transfer timing by a transfer-timing-adjustment roller pair 44 arranged in the transport path.

In the intermediate transfer device 30, for example, in an image forming operation, the toner images of the respective colors respectively formed on the photoconductor drums 21 in the imaging units 2 (Y, M, C, K) are successively first transferred on the outer peripheral surface of the intermediate transfer belt 31 by a transfer action of the first transfer device 34 in a manner that the positions of the toner images are aligned with each other. At this time, in the imaging units 2 (Y, M, C, K), the drum cleaning devices 26 clean up the outer peripheral surfaces of the photoconductor drums 21 after the first transfer. Then, the intermediate transfer belt 31 transports the first transferred toner images to the second transfer position at which the intermediate transfer belt 31 faces the second transfer device 35. Then, the intermediate transfer device 30 second transfers the toner images on the intermediate transfer belt 31 onto the recording sheet 9 supplied from the sheet feed device 40 to the second transfer position by the transfer action of the second transfer device 35. Also, in the intermediate transfer device 30, the belt cleaning device 36 cleans up the outer peripheral surface of the intermediate transfer belt 31 after the second transfer.

The fixing device 45 includes a heating rotational body 46 in a roller shape, a belt shape, or other shape that is rotationally driven in a predetermined direction, is heated by a heating unit so that the surface temperature is held at a predetermined temperature; and a pressing rotational body 47 in a roller shape, a belt shape, or other shape that contacts the heating rotational body 46 with a predetermined pressure so as to be substantially arranged along the rotation-axis direction of the heating rotational body 46 and is rotated by following the rotation of the heating rotational body 46.

In the fixing device 45, in image formation, the recording sheet 9 with the toner images second transferred thereon at the intermediate transfer device 30 is sent to a pressure-contact part between the heating rotational body 46 and the pressing rotational body 47 and is heated and pressed. Accordingly, the toner images are molten and fixed to the recording sheet 9. The fixed recording sheet 9 is moved in the transport path indicated by the dotted-chain line, is output to the outside of the housing 10 by an output roller pair 48 arranged in the transport path, and then is housed in the output housing portion 12.

The image forming apparatus 1 is able to form a color image configured by combining all or part of the toners of the four colors (Y, M, C, K) by selectively operating all or part (however, plural) of the imaging units 2 (Y, M, C, K). Also, the image forming apparatus 1 is able to form a monochrome image configured of a single-color toner of, for example, black by operating one of the imaging units 2 (Y, M, C, K).

Configuration of Imaging Unit Etc.

As shown in FIGS. 2 to 5 etc., each of the above-described imaging units 2 (Y, M, C, K) is configured such that the photoconductor drum 21, the charging device 22, the developing device 24 (Y, M, C, K), and the drum cleaning device 26 are supported and integrated by the support frame 20. The support frame 20 includes at least two side plates 20A and 20B, and also a coupling member that couples the side plates 20A and 20B and other member as required.

For example, the photoconductor drum 21 uses a configuration in which a photosensitive layer formed of an organic conductive material or the like is formed on the outer peripheral surface of a cylindrical conductive base body that is grounded. The photoconductor drum 21 has disk-shaped flange portions 212 and 213 configuring portions of the conductive base body at both ends in the longitudinal direction of the photoconductor drum 21. Also, the photoconductor drum 21 is attached so that the rotation shafts at both end portions thereof are rotatable relative to the side plates 20A and 20B. Further, the photoconductor drum 21 is configured such that a rotational power is transmitted to the photoconductor drum 21 because a driven gear 214 arranged inside a shaft portion 215 provided at the end portion at the deep side when the imaging unit 2 is mounted meshes with a driving gear arranged inside a shaft-portion receiving portion of a rotationally driving device (not shown) arranged at the housing 10 of the image forming apparatus 1.

The charging device 22 uses a contact charging device in which the charging roller 221 contacts the outer peripheral surface of the photoconductor drum 21 and is rotated by following the photoconductor drum 21. The charging roller 221 is attached so that both end portions thereof are rotatable relative to the side plates 20A and 20B. Also, the charging roller 221 includes a cleaning brush roller 222 that contacts the outer peripheral surface of the charging roller 221 and rotates.

Further, as the developing device 24 (Y, M, C, K), for example, a two-component developing device that uses a two-component developer containing a toner and a carrier is used. The two-component developing device 24 includes a housing 240 that houses a developer. The developing device 24 also includes, in the housing 240, a development roller 241 having a rotating cylindrical sleeve 242 and a magnet roller 243 arranged in the sleeve 242; stirring and transporting members 245 and 246 such as screw augers that stir the developer housed in the housing 240 and transport the developer in a circulating manner so that the toner passes through the development roller 241; and a rod-shaped layer-thickness restricting member 247 that restricts the amount of developer (layer thickness) held by the sleeve 242 of the development roller 241. Disk-shaped tracking rollers 244 are provided at the both end portions of the development roller 241. The tracking rollers 244 contact portions of the photoconductor drum 21 (outer peripheral surfaces of the flange portions 212 and 213) and hold gaps between the development roller 241 and the image formation surface of the photoconductor drum 21.

The drum cleaning device 26 includes, in a housing thereof, a cleaning member 261 such as an elastic plate that contacts the photoconductor drum 21 and scrapes and removes an unnecessary substance such as a remaining toner, and a rotating and transporting member 262 such as a screw auger that sends out the remaining toner scraped and removed by the cleaning member 261 as a waste toner to a recovery container (not shown). The drum cleaning device 26 is attached so that both end portions thereof are fixed to the side plates 20A and 20B.

In the imaging unit 2 (Y, M, C, K), as shown in FIGS. 2 to 5 etc., the developing device 24 (Y, M, C, K) is supported by the side plates 20A and 20B to be able to swing in directions indicated by arrow P1 and arrow P2 about pivot portions 28A and 28B.

Figure 5:
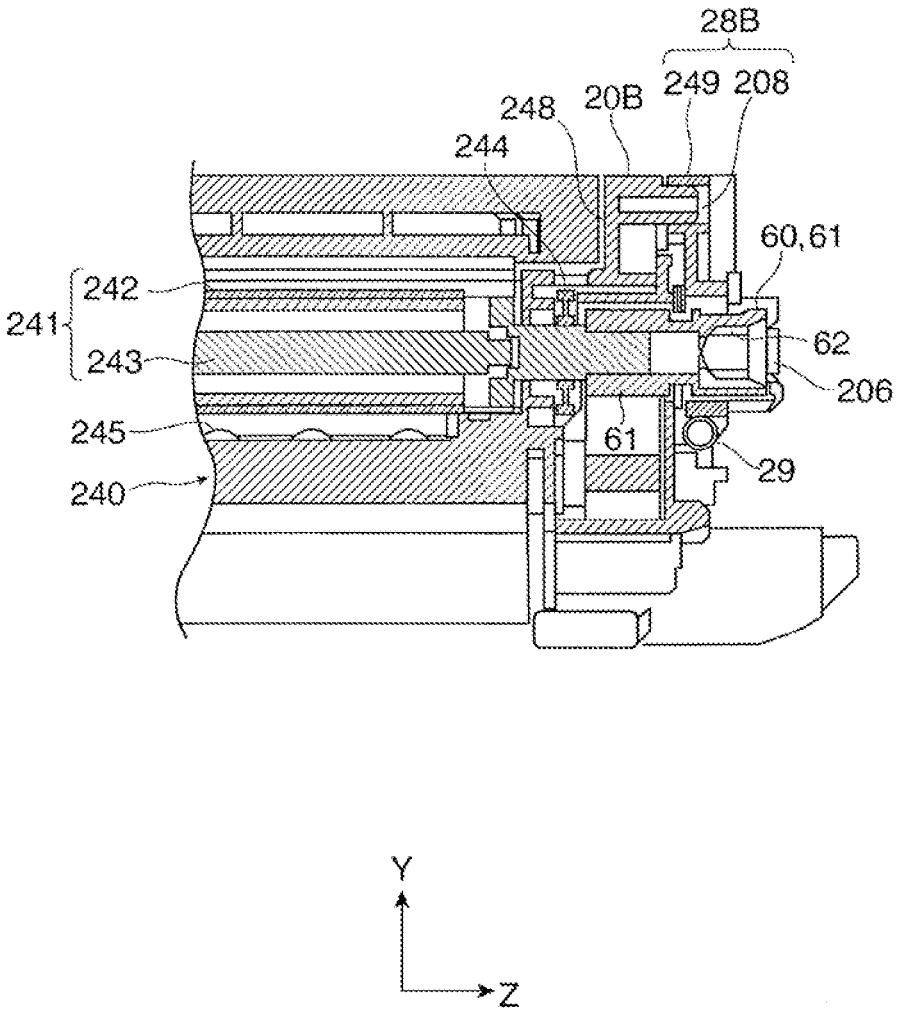
FIG. 5 is a schematic cross-sectional view showing a portion of a deep-side end portion (developing device and driven-side coupling) of the imaging unit in FIG. 2.

To be specific, each of the pivot portions 28A and 28B includes a swing shaft portion 249 provided at a portion of the housing 240 of the developing device 24, and a hole-shaped swing-shaft receiving portion 208 provided at an upper portion of the side plates 20A, 20B to receive the swing shaft portion 249 in a rotatably fitted manner and support the swing shaft portion 249 (see FIG. 5). The swing shaft portion 249 of the developing device 24 is provided with a swing arm portion 248. The swing arm portion 248 has a shape in which a side surface portion with one of both end portions of the development roller 241 arranged in the housing 240 of the developing device extends to the upper side in the gravity direction (a direction along a coordinate-axis Y direction in the drawing). Then, the swing shaft portion 249 protrudes outward from an upper end portion of the swing arm portion 248.

Also, the pivot portions 28A and 28B are arranged at positions of the side plates 20A and 20B at which the developing device 24 swings in a direction P1 toward the photoconductor drum 21 by the self weight. In the first exemplary embodiment, the pivot portions 28A and 28B are arranged, for example, at positions closer to the photoconductor drum 21 than a straight line in the gravity direction passing through the center of gravity of the entire developing device 24.

Accordingly, in the imaging unit 2, the developing device 24 is constantly supported in a state in which the developing device 24 swings in the direction P1 toward the photoconductor drum 21 about the pivot portions 28A and 28B in the support frame 20.

Figure 6A:
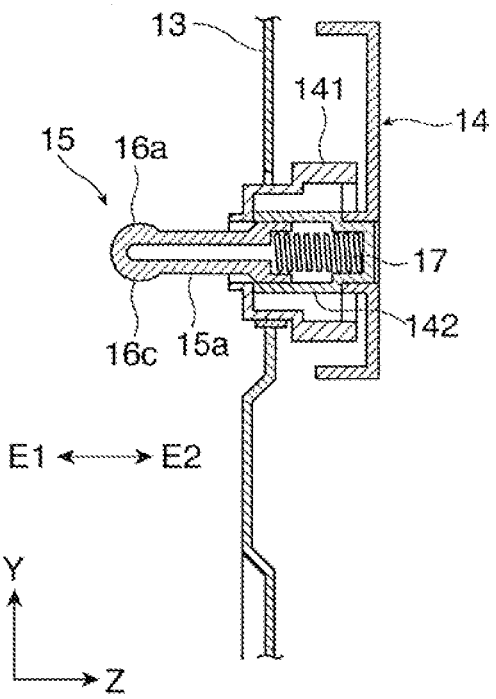
FIG. 6A is a schematic cross-sectional view showing a portion of a mount portion to which the imaging unit of the image forming apparatus in FIG. 1 is mounted (for example, driving-side coupling)
Figure 6B:
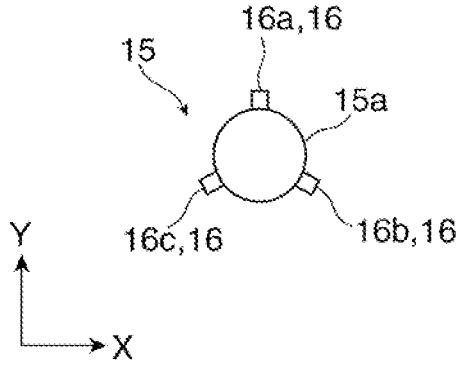
FIG. 6B is a front schematic view showing a state in which the driving-side coupling is viewed in a direction indicated by arrow E2 in FIG. 6A.
Figure 7:
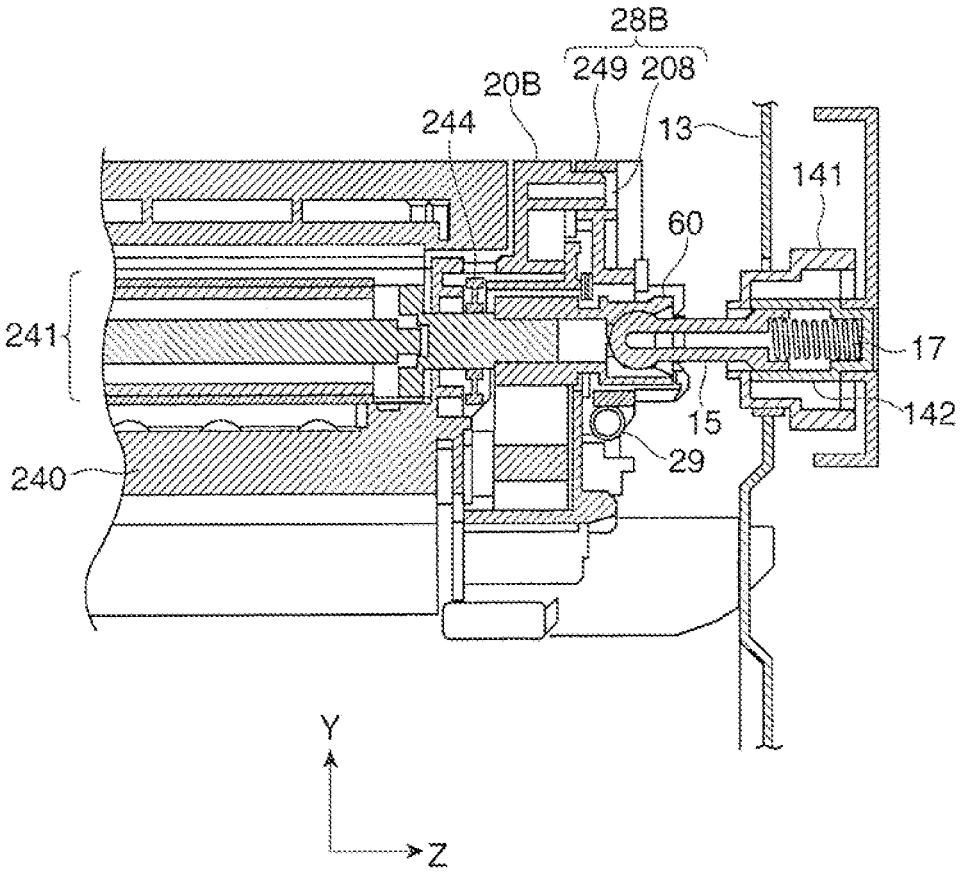
FIG. 7 is a schematic cross-sectional view showing a portion in a state in which the imaging unit in FIG. 2 is mounted to the mount portion (FIG. 6A) in the image forming apparatus.

Also, in this imaging unit 2 (Y, M, C, K), a driven-side coupling 60 that transmits a rotational power to the development roller 241 (actually, sleeve 242) is provided at a first end portion of the development roller 241 in each developing device 24 (Y, M, C, K). As shown in FIGS. 6A, 6B, 7, etc., the driven-side coupling 60 is coupled in a removably inserted manner to a driving-side coupling 15 arranged at the housing 10 of the image forming apparatus 1 and receives the transmitted rotational power. The rotational power is transmitted to the driven-side coupling 60 by the coupling to the driving-side coupling 15.

In the first exemplary embodiment, as shown in FIG. 7 etc., the driving-side coupling 15 applies a form provided with three claws 16 that restrict movement (stop movement, engagement) of the development roller 241 in a rotation direction B when coupled to the driven-side coupling 60.

To be specific, the driving-side coupling 15 has three claws 16*a*, 16*b*, and 16*c* having protruding shapes being slightly long in the insertion/removal direction of the coupling. The claws 16*a*, 16*b*, and 16*c* are provided on the peripheral surface at a coupling-side end portion of a cylindrical body 15*a*, at equivalent intervals in the rotation direction of the coupling.

Also, as shown in FIGS. 6A, 6B, 7, etc., the driving-side coupling 15 is arranged at an inner frame 13 configuring the mount portion of the imaging unit 2 in the housing 10 of the image forming apparatus 1 so that the coupling 15 protrudes in a direction in which the coupling 15 faces a deep-side end portion of the mounted imaging unit 2.

Further, the driving-side coupling 15 is housed in a coupling housing portion 142 in a displaceable manner. The coupling housing portion 142 is provided in a transmission gear 141 configuring a portion of a gear-train mechanism portion 14 that transmits a rotational power of a rotationally driving device (not shown) arranged in the housing 10 of the image forming apparatus 1. To be specific, an attachment-side end portion of the coupling body 15*a* of the driving-side coupling 15 is fitted to the coupling housing portion 142 in a displaceable manner in substantially horizontal directions (for example, directions along the Z coordinate axis). Also, the attachment-side end portion is coupled to a second end of a coil spring 17 whose first end is fixed to the coupling housing portion 142, so that the driving-side coupling 15 is elastically displaceable by a spring force of the coil spring 17.

Figure 3:
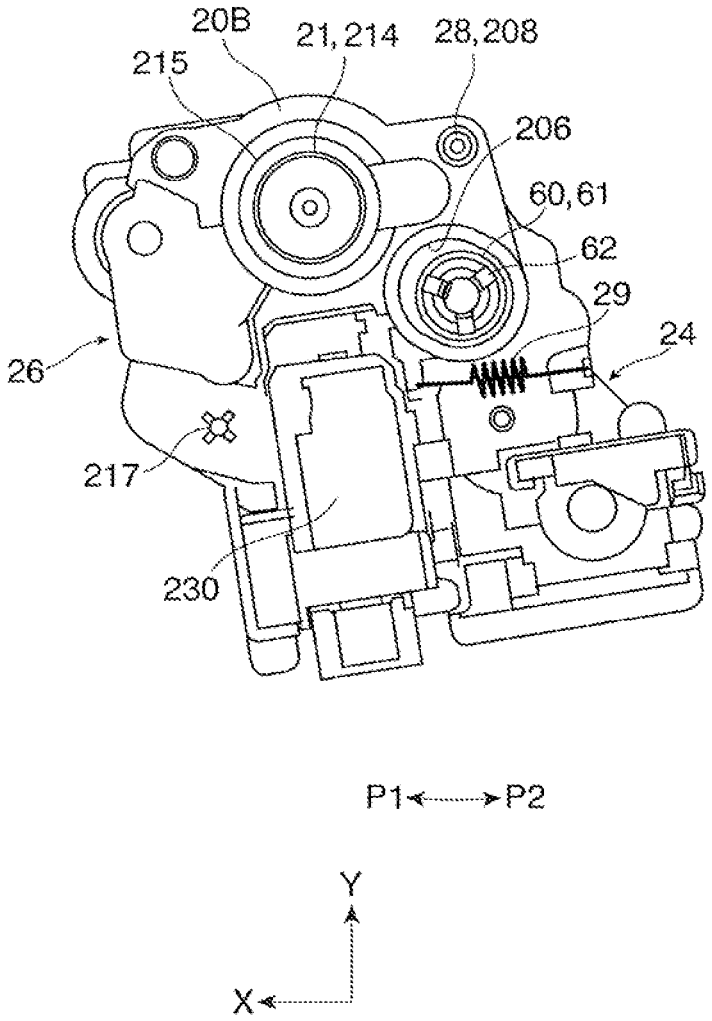
FIG. 3 is a back-surface external view showing a state when the imaging unit in FIG. 2 is viewed in a direction indicated by arrow III (the deep side of the apparatus)
Figure 4:
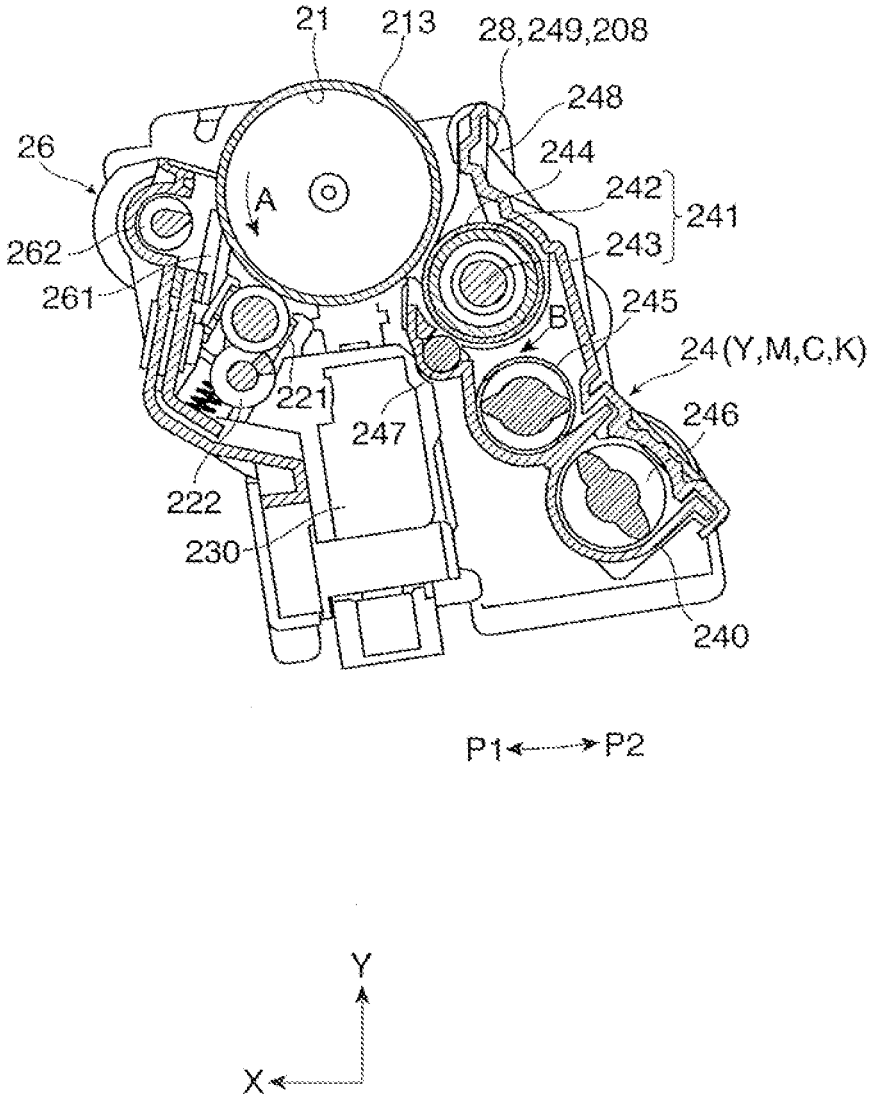
FIG. 4 is a schematic cross-sectional view taken along line IV-IV of the imaging unit in FIG. 2.

In contrast, as shown in FIGS. 3, 5, etc., the driven-side coupling 60 provided at the first end portion of the development roller 241 has a columnar coupling recess portion at a coupling-side end portion of a cylindrical body 61. The coupling-side end portion of the body 15*a* of the driving-side coupling 15 is fitted into the coupling recess portion. The driven-side coupling 60 also has three claw receiving grooves 62 at an inner wall surface of the coupling recess portion. The claw receiving grooves 62 receive and hold the three claws 16*a*, 16*b*, and 16*c* of the driving-side coupling 15.

Also, an attachment-side end portion of the body 61 of the driven-side coupling 60 is fixed to the rotation shaft portion of the development roller 241. Further, the driven-side coupling 60 is exposed to the outside from an opening portion 206 provided at the side plate 20B at the deep side when the imaging unit 2 is mounted.

As shown in FIG. 7, when the imaging unit 2 (Y, M, C, K) is mounted to the mount portion of the image forming apparatus 1, the driven-side coupling 60 provided at the development roller 241 is coupled to the driving-side coupling 15 provided at the mount portion of the image forming apparatus 1.

In particular, the coupling-side end portion of the driving-side coupling 15 is inserted into the coupling recess portion of the driven-side coupling 60 at the imaging unit 2 that is moved to the deep side (coordinate-axis Z direction) of the image forming apparatus 1, and then the three claws 16*a*, 16*b*, and 16*c* of the driving-side coupling 15 are respectively inserted into the three claw receiving grooves 62 of the driven-side coupling 60. Thus, coupling is completed.

Accordingly, the rotational power of the driving-side coupling 15 is transmitted through the driven-side coupling 60 to the development roller 241 in each developing device 24. Consequently, the development roller 241 is rotationally driven in the predetermined direction B.

When the imaging unit 2 is mounted to the mount portion of the image forming apparatus 1, the image forming apparatus 1 at mounting is positioned, for example, such that the shaft portion 215 of the photoconductor drum 21 is fitted into a shaft-portion receiving portion provided at the mount portion. The positioning when the imaging unit 2 is mounted is executed, for example, by fitting the shaft portion 215 (see FIGS. 2 and 3) of the photoconductor drum 21 into the shaft-portion receiving portion provided at the mount portion, fitting a positioning protrusion 217 (see FIG. 3) provided at the side plate 20B of the support frame 20 into a positioning hole provided at the mount portion, bringing a positioning protruding portion 216 (see FIG. 2) provided at the side plate 20B of the support frame 20 into contact with a positioning recess portion provided at the mount portion and fitting the positioning protruding portion 216 into the positioning recess portion, etc.

Figure 8:
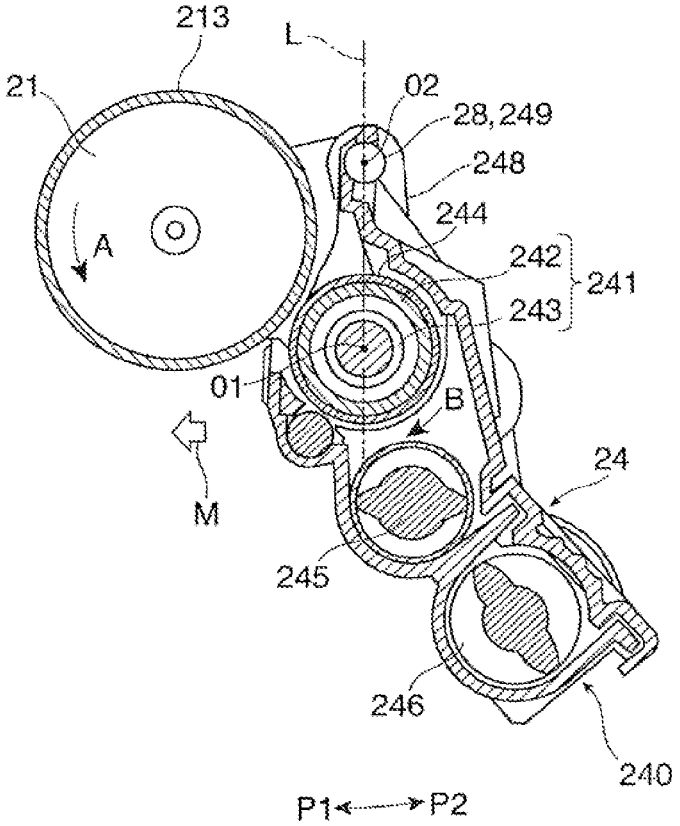
FIG. 8 is a cross-sectional explanatory view showing a major portion of the imaging unit in FIG. 2 (photoconductor drum, developing device, etc.)

Further, in this imaging unit 2 (Y, M, C, K), as shown in FIG. 8 etc., when each development roller 241 is rotationally driven by receiving the rotational power from the driving-side coupling 15, the development roller 241 of the developing device 24 (Y, M, C, K) is rotated in a direction in which an action (moment) is generated in a direction indicated by arrow M or the direction indicated by arrow P1 in which the developing device 24 approaches to the photoconductor drum 21.

In the first exemplary embodiment, as shown in FIG. 8 etc., the development roller 241 in each developing device 24 (Y, M, C, K) is rotated in the direction indicated by arrow B relative to the photoconductor drum 21 rotationally driven in the direction indicated by arrow A. In other words with regard to the photoconductor drum 21 rotationally driven in the direction indicated by arrow A and a pivot portion 28, the development roller 241 is set to rotate so that a rotation direction of a surface of the development roller 241 at an intersection position far from the pivot portion 28 intersecting with an imaginary line L passing through a center (pivot) 02 of the pivot portion 28 and a rotation center 01 of the development roller 241 is a direction toward the photoconductor drum 21.

As shown in FIG. 3 etc., in each imaging unit 2 according to the first exemplary embodiment, a coil spring 29 is provided. The coil spring 29 prevents the developing device 24 to unintentionally swing about the pivot portion 28 in an orientation (direction) away from the photoconductor drum 21 indicated by arrow P2. That is, a first end portion of the coil spring 29 is attached to a portion located at a substantially intermediate position between the development roller 241 and the stirring and transporting member 245 in the housing 240 of the developing device 24, and a second end portion of the coil spring 29 is attached to a portion separated from the pivot portion 28 of the support frame 20.

The coil spring 29 also functions as an elastic urging member that applies a slight force that consequently causes the developing device 24 to elastically swing in the direction P1 toward the photoconductor drum 21 about the pivot portion 28.

Use and Operation State of Imaging Unit Etc.

When the imaging unit 2 (Y, M, C, K) with the above-described configuration is used, the imaging unit 2 is mounted by executing a moving operation so that the imaging unit 2 is inserted toward the deep side (direction indicated by arrow Z) of the image forming apparatus 1 with respect to the mount portion of the housing 10 of the image forming apparatus 1. Each imaging unit 2 at this time is fixed to the mount portion by a fixing portion (not shown).

At mounting, the shaft portion 215 in the photoconductor drum 21 of each imaging unit 2 is fitted into the shaft-portion receiving portion (not shown) provided at the mount portion of the image forming apparatus 1, and the driven gear 214 in the photoconductor drum 21 meshes with the driving gear (not shown) provided at the mount portion of the image forming apparatus 1.

Also, at mounting, the driven-side coupling 60 in the developing device 24 of each imaging unit 2 is coupled to the driving-side coupling 15 provided at the mount portion of the image forming apparatus 1 (see FIG. 7). To be specific, the coupling-side end portion of the driving-side coupling 15 is inserted into the coupling recess portion of the driven-side coupling 60, and then the three claws 16*a*, 16*b*, and 16*c* of the driving-side coupling 15 are respectively inserted into and accommodated in the three claw receiving grooves 62 of the driven-side coupling 60 as described above. Thus, coupling is completed.

Then, at image formation etc. of the image forming apparatus 1, the rotational power is transmitted to the imaging unit 2 (Y, M, C, K) from the rotationally driving device (not shown) at the body of the image forming apparatus 1 through drive transmission portions, such as the driving gear, the driving-side coupling 15, etc.

Accordingly, the photoconductor drum 21 in the imaging unit 2 receives the rotational power transmitted from the driving gear (not shown) through the driven gear 214 and starts to be rotationally driven in the direction indicated by arrow A. Also, the development roller 241 (sleeve 242) of the developing device 24 in the imaging unit 2 receives the rotational power transmitted from the driving-side coupling 15 through the driven-side coupling 60 and starts to be rotationally driven in the direction indicated by arrow B. Further, in the developing device 24, since the stirring and transporting members 245 and 246 are connected to the development roller 241 by a gear transmission mechanism (not shown), the stirring and transporting members 245 and 246 receive the rotational power transmitted by the development roller 241, and start to be rotationally driven in predetermined directions.

In particular, in each imaging unit 2, the developing device 24 swings in the direction P1 toward the photoconductor drum 21 about the pivot portions 28A and 28B in the support frame 20 by the self weight as described above. Also, in the developing device 24, since the development roller 241 is rotationally driven in the direction indicated by arrow B as described above, an acting force (moment of force) M is generated at the development roller 241 to swing the developing device 24 in the direction P1 toward the photoconductor drum 21 as exemplarily shown in FIG. 8.

Also, as the driving-side coupling 15 and the driven-side coupling 60 for transmitting the rotational power to the development roller 241, the image forming apparatus 1 and each imaging unit 2 employ the coupling member provided with the three claws 16*a* to 16*c*. Accordingly, a variation in torque is restricted, and almost no biting vibration is generated between the driving-side coupling 15 and the driven-side coupling 60. The rotational power is stably transmitted to the development roller 241.

Consequently, in each imaging unit 2, the stable rotational power without a variation etc. is stably transmitted to the development roller 241 although the rotational power is transmitted from the driving-side coupling 15 through the driven-side coupling 60 to the development roller 241 in the developing device 24. Also, the tracking roller 244 of the development roller 241 continuously stably contacts (the flange portions 212 and 213 of) the photoconductor drum 21.

Hence, in each imaging unit 2 (Y, M, C, K), the gap between the development roller 241 in the developing device 24 (Y, M, C, K) and the photoconductor drum 21 is continuously stably held, and hence stable development is executed. Accordingly, in the image forming apparatus 1, a development failure resulting from the gap being unstable in the imaging unit 2 (Y, M, C, K) and a development failure resulting from unevenness in rotation speed are prevented from being generated, and insufficiency in image quality resulting from these development failures is not generated. Evaluation Test Etc.

In an evaluation test, the imaging unit 2K (example) according to the first exemplary embodiment is mounted to a device imitating the unit mount portion of the image forming apparatus 1, and the pressure-contact force (tracking force) when the tracking roller 244 of the development roller 241 in a developing device 24K of the imaging unit 2K contacts the photoconductor drum 21 is measured.

Major conditions of the imaging unit 2K used in this evaluation test are as follows.

As the photoconductor drum 21, a test structure is used in which a cylindrical member made of an aluminum alloy simulating an organic photoconductor drum with an outer diameter of about 30 mm is applied, and a load cell (load converter) is arranged in the cylindrical member. The developing device 24K includes the development roller 241 having the sleeve 242 with an outer diameter of about 16 mm, and has the entire mass of about 430 g (including the weight of an initial housing amount of developer). The developing device 24K employs, as the pivot portion 28, a pivot portion configured such that the distance from the rotation center 01 of the development roller 241 to the pivot 02 along the gravity direction (coordinate-axis Z direction) is about 20 mm, the arranged position is closer by about 1 mm to the photoconductor drum 21 along the horizontal direction (coordinate-axis X direction) than the straight line along the gravity direction passing through the rotation center 01 of the development roller 241. The developing device 24K is supported to be able to swing about the pivot portion. The development roller 241 receives the rotational power transmitted from the driving-side coupling 15 through the driven-side coupling 60, and hence the development roller 241 is rotationally driven in the arrow B direction at a rotation speed of 50 to 400 mm/sec.

The tracking force is measured such that the test structure arranged with the load cell is assumed as the photoconductor drum 21 and is mounted to the imaging unit 2, a voltage input recorder is connected to the load cell, and the result is recorded. The measurement at this time is executed for at least a predetermined time (in this case, 4 seconds) from a state in which rotation of the development roller 241 is stopped to a state in which the development roller 241 receives the rotational power, starts to be rotationally driven, and rotates at a stable speed.

Figure 9:
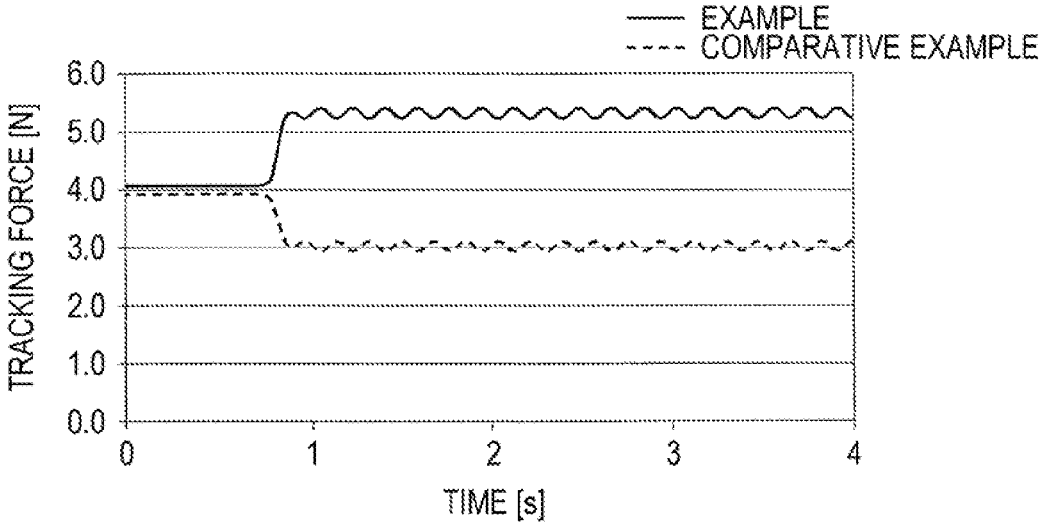
FIG. 9 is a graph showing a result of an evaluation test.

FIG. 9 shows the measurement result of this example. In FIG. 9, a time period in which the tracking force is about 4.0 N (a time slightly before the elapsed time is 1 second=1 s)

corresponds to a time period in which the rotation of the development roller 241 is stopped (at rotation stop).

Figure 13:
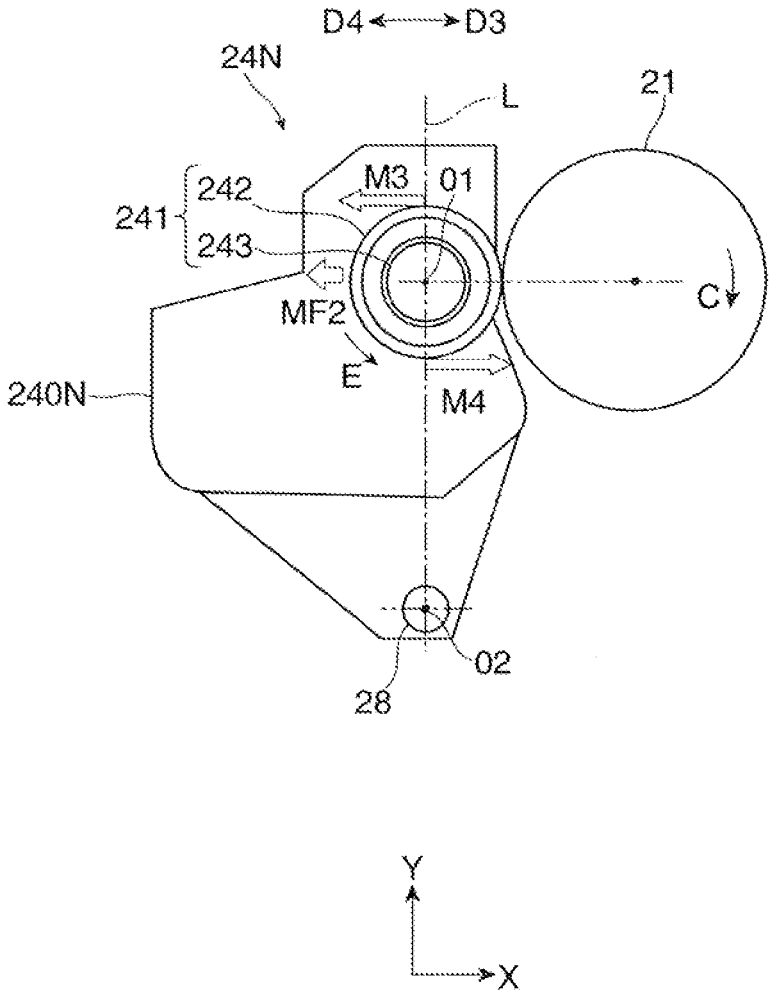
FIG. 13 is an explanatory view conceptually showing a configuration of an imaging unit of a comparative example used in an evaluation test and respective acting forces of the configuration.

Also, for comparison, the imaging unit including a developing device 24N with a configuration schematically shown in FIG. 13 is prepared, and then measurement similar to the measurement of the example is executed by using the image forming apparatus 1 (comparative example) with the imaging unit mounted. The measurement result of this comparative example is also shown in FIG. 9.

In the imaging unit according to the comparative example, the photoconductor drum 21 is rotationally driven in a direction indicated by arrow C. In the imaging unit according to the comparative example, the developing device 24N is supported by the support frame at a lower portion thereof so that the developing device 24N swings in directions indicated by arrow D3 and arrow D4 about the pivot portion 28. Also, the rotational power is transmitted to the development roller 241 in the developing device 24N from the driving-side coupling 15 through the driven-side coupling 60 similarly to the example, and the development roller 241 is rotationally driven in a direction indicated by arrow E. In this case, a rotation direction C of the photoconductor drum 21 in FIG. 13 is viewed from the near side of the mount portion of the image forming apparatus 1, and hence is substantially similar to the rotation direction (indicated by arrow A) of the photoconductor drum 21 according to the example. Also, the developing device 24N swings in a direction away from the photoconductor drum 21 indicated by arrow D4 about the pivot portion 28 in the support frame 20.

Also, the major conditions of the imaging unit according to the comparative example are as follows.

The photoconductor drum 21 has the same configuration as the example. The developing device 24N includes the development roller 241 having the sleeve 242 with an outer diameter of about 16 mm, and has the entire mass of about 600 g. The developing device 24N employs, as the pivot portion 28, a pivot portion configured such that the distance from the rotation center 01 of the development roller 241 to the pivot 02 along the gravity direction (coordinate-axis Z direction) is about 31 mm, the pivot portion is arranged on the straight line along the gravity direction passing through the rotation center 01 of the development roller 241 (configuration in which a displacement amount between the straight line and the photoconductor drum 21 is about 0 mm). The developing device 24N is supported to be able to swing about the pivot portion. The development roller 241 receives the rotational power transmitted from the driving-side coupling 15 through the driven-side coupling 60, and hence the development roller 241 is rotationally driven in the arrow E direction at a rotation speed of about 220 mm/sec. The rotation direction E of the development roller 241 is substantially the same as the rotation direction (direction indicated by arrow B) of the development roller 241 according to the example by a reason similar to the rotation direction of the above-described photoconductor drum 21.

Referring to the result shown in FIG. 9, it is found from the example that, when the development roller 241 starts to be rotationally driven according to the example, the tracking force increases as compared with the tracking force at rotation stop, and the tracking roller 244 of the development roller 241 continuously stably contacts the photoconductor drum 21. In contrast, it is found from the comparative example that, when the development roller 241 starts to be rotationally driven, the tracking force decreases as compared with the tracking force at rotation stop, and the tracking roller 244 of the development roller 241 tends to contact the photoconductor drum 21 with a relatively small force in an unstable state.

In each of the example and the comparative example, the tracking force varies by small steps expectedly because of, for example, a variation in distance from the center 01 of the development roller 241 to the contact portion of the claws at coupling between the couplings 15 and 60, a variation in component force, and a variation in phase, resulting from the posture of the driving-side coupling 15 and a variation in angle of the plural claw receiving grooves 62 of the driven-side coupling 60. However, the variation at this level is a very small variation that is negligible in practical use. Also, in each of the example and the comparative example, the tracking force at rotation stop is generated by an acting force provided by a combination of a swing force by the self weight of the developing device and a spring force of the coil spring 29 as described above.

For reference purpose, the development roller 241 is rotated in a reverse direction (direction opposite to the direction indicated by arrow B) and the tracking force is measured according to the example. Then, it is recognized that a result similar to the result of the comparative example is obtained.

In the imaging unit 2 and the image forming apparatus 1 according to the example, as described above, the coupling member provided with the three claws 16*a* to 16*c* is employed as the driving-side coupling 15 and the driven-side coupling 60. Hence, the rotational power is transmitted to the development roller 241 from the respective three claws 16*a* to 16*c* in a strict sense.

Figure 10:
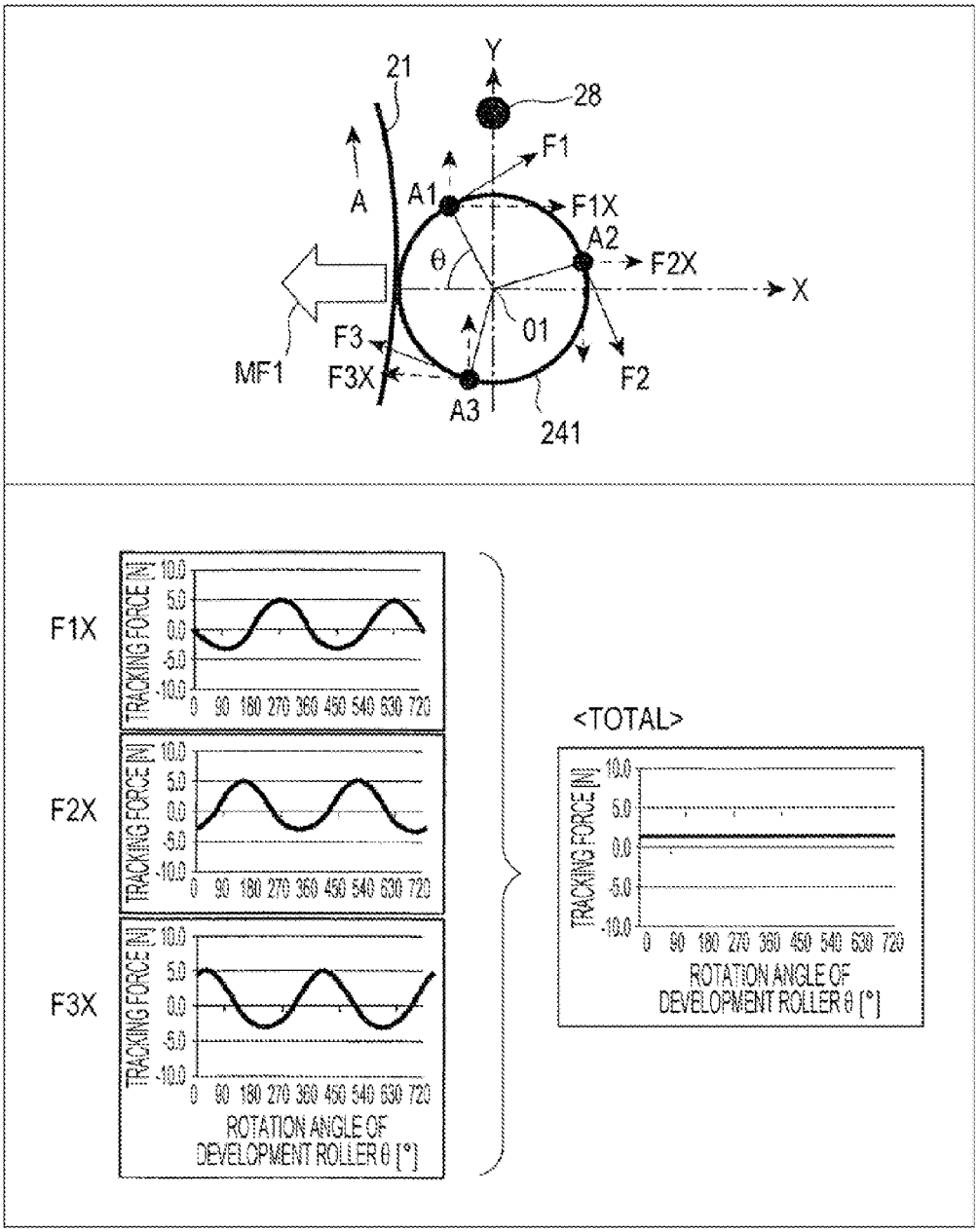
FIG. 10 is an explanatory view showing a force generation state when a rotational power is transmitted to a development roller through a coupling member provided with three claws, measurement results of tracking forces by the respective claws, and a total result of the respective measurement results.

If the state of the rotational power that is transmitted from the driving-side coupling 15 through the driven-side coupling 60 to the development roller 241 is illustrated, the illustration may be an upper section of FIG. 10. In FIG. 10, reference signs A1, A2, and A3 indicate the positions of the three claws 16*a* to 16*c*. That is, it is assumed that powers F1, F2, and F3 are transmitted from the respective claws to the development roller 241. The powers F1, F2, and F3 have component forces F1X, F2X, and F3X of the X component divided as a component force directed in the direction toward the photoconductor drum 21.

Therefore, in addition to the above-described evaluation test, how the component forces F1X, F2X, and F3X of the X component of the respective powers act on the development roller 241 during rotation is checked.

The results of the checked tracking forces of the X components F1X, F2X, and F3X of the respective powers are illustrated in a lower left section of FIG. 10 to meet the rotation angle θ(°) of the development roller 241. The tracking forces each appear as a result that changes to draw a sinusoidal curve waveform including a plus value and a minus value with a phase difference of 120° corresponding to the arrangement relationship of the three claws.

Then, when the respective tracking forces of the component forces F1X, F2X, and F3X of the X component of the respective powers are added, the result shown in a lower right section in FIG. 10 is obtained.

That is, when the component forces F1X, F2X, and F3X of the X component at this time are added, a constant tracking force at the plus side is obtained. In a strict sense, the total tracking force has a waveform that periodically vertically varies with a very small width because of a variation in component force and a displacement in phase.

Figure 11:
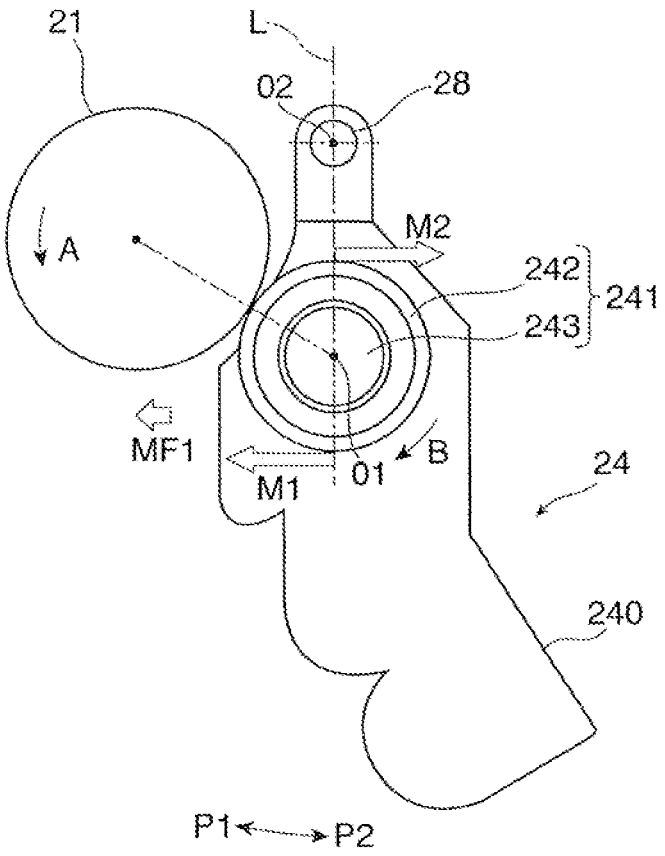
FIG. 11 is an explanatory view conceptually showing a configuration of the imaging unit in FIG. 2 and respective acting forces of the configuration.

With regard to this, in the imaging unit 2 of the example, as conceptually shown in FIG. 11, when the development roller 241 of the developing device 24 is rotationally driven in the direction indicated by arrow B, it is expected that an acting force (moment of force) indicated by arrow M1 toward the photoconductor drum 21 resulting from the component forces F1X, F2X, and F3X of the X component and an acting force (moment of force) indicated by arrow M2 away from the photoconductor drum 21 are generated.

If the driving coupling member (or driven coupling member), for example, represented by the driving-side coupling 15 having the three claws 16*a* to 16*c* is employed, the acting force indicated by arrow M1 is larger than the acting force indicated by arrow M2, and this relationship acts as the moment MF1 by the total driving force obtained by adding the component forces F1X, F2X, and F3X of the X component. Consequently, in the imaging unit 2 of the example, when the development roller 241 starts to be rotationally driven in the direction indicated by arrow B, it is expected that the above-described moment MF1 is generated as an acting force that causes the developing device 24 to swing in the direction P1 toward the photoconductor drum 21.

In contrast, in the imaging unit of the comparative example, as conceptually shown in FIG. 13, when the development roller 241 of the developing device 24N is rotationally driven in the direction indicated by arrow E, it is expected that an acting force indicated by arrow M4 toward the photoconductor drum 21 and an acting force indicated by arrow M3 away from the photoconductor drum 21 resulting from the component forces F1X, F2X, and F3X of the X component are generated similarly to the example.

Also, in the imaging unit of the comparative example, the acting force indicated by arrow M3 is larger than the acting force indicated by arrow M4, and this relationship acts as a moment MF2 by the total driving force obtained by adding the component forces F1X, F2X, and F3X of the X component. Consequently, in the imaging unit 2 of the comparative example, when the development roller 241 starts to be rotationally driven in the direction indicated by arrow E, it is expected that the above-described moment MF2 is generated as an acting force that causes the developing device 24 to swing in the direction D4 away from the photoconductor drum 21.

If the above-described content is reviewed, the configuration of the pivot portion 28 of the developing device 24 in the imaging unit 2 according to the first exemplary embodiment may be considered as follows.

Figure 12:
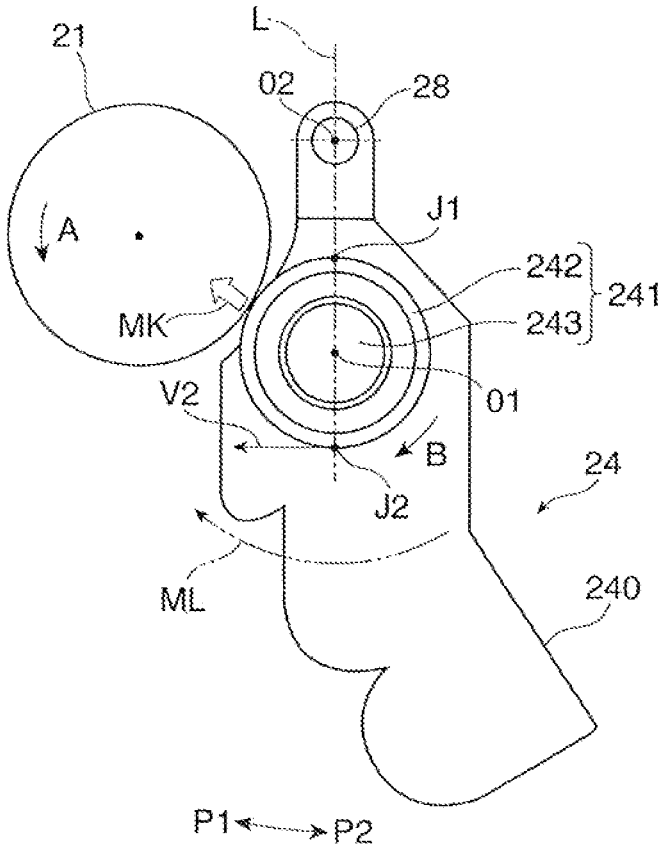
FIG. 12 is an explanatory view conceptually showing a configuration of the imaging unit in FIG. 2 and the respective acting forces of the configuration in a different viewpoint.

That is, as shown in FIG. 12, the pivot portion 28 of the developing device 24 is arranged at a position at which a moment ML generated around the pivot 02 acts in a direction in which the development roller 241 contacts the photoconductor drum 21 (final moment MK), with respect to a tangential vector V2 directed in the rotation direction B of the development roller 241 at an intersection point J2 far from the pivot 02 included in intersection points J1 and J2 at which the imaginary line L connecting the pivot 02 with the rotation center 01 of the development roller 241 intersects with the surface of (the sleeve 242 of) the development roller 241.

Finally, a case employing a coupling member provided with two claws 16*a* and 16*b* as the driving-side coupling 15 and the driven-side coupling 60 is checked.

Figure 14:
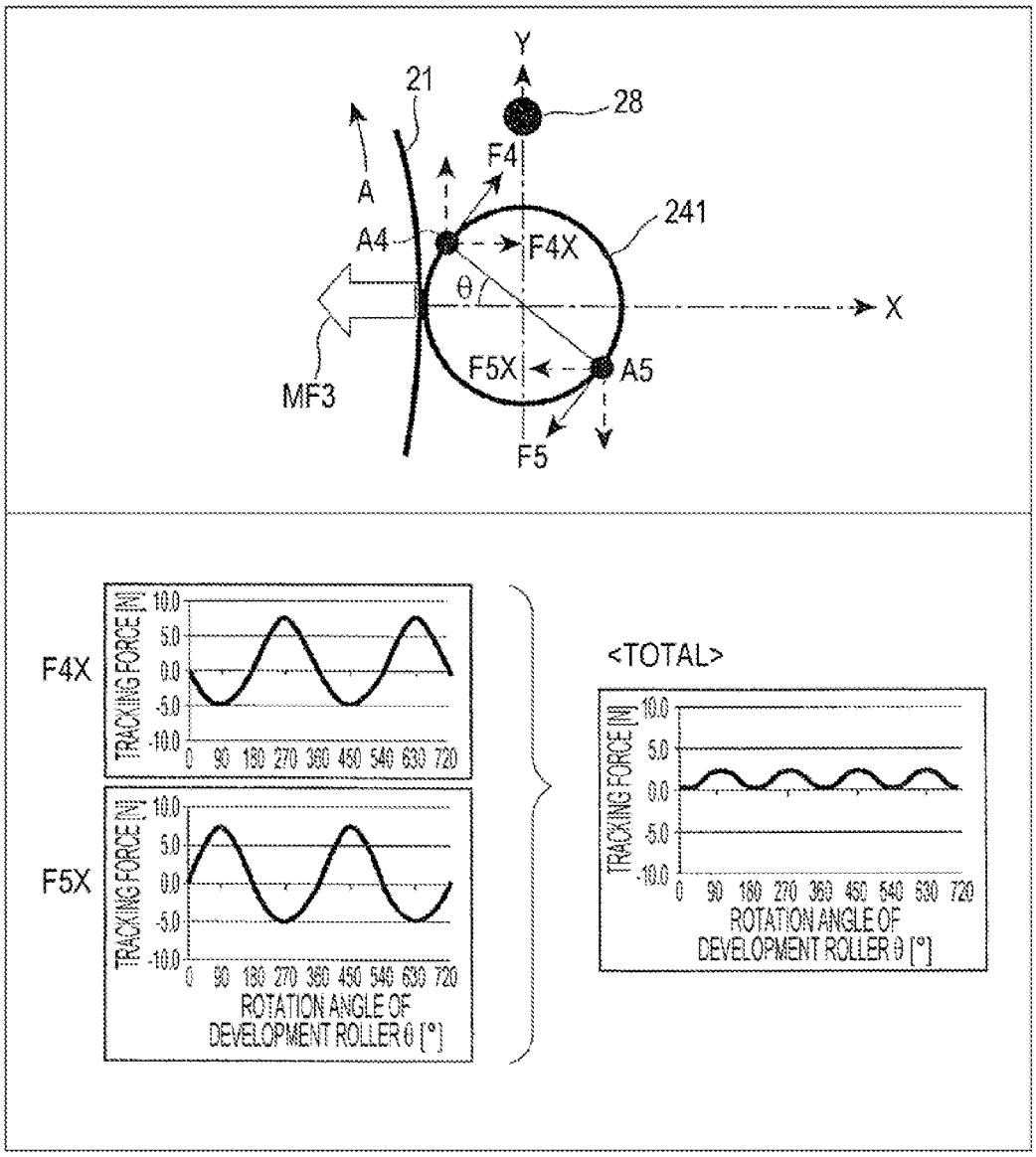
FIG. 14 is an explanatory view showing a force generation state when a rotational power is transmitted to a development roller through a coupling member provided with two claws, measurement results of tracking forces by the respective claws, and a total result of the respective measurement results.

In this case, the rotational power is transmitted to the development roller 241 from the two claws 16*a* and 16*b* in a strict sense. If the state of the rotational power that is transmitted from the driving-side coupling 15 through the driven-side coupling 60 to the development roller 241 is illustrated, the illustration may be an upper section of FIG. 14. In FIG. 14, reference signs A4 and A5 indicate the positions of the two claws 16*a* and 16*b*. That is, it is considered that, in this case, powers F4 and F5 are transmitted to the development roller 241 from the respective claws. The powers F4 and F5 have component forces F4X and F5X of the X component divided as a component force directed in the direction toward the photoconductor drum 21.

Then, respective tracking forces of the X component forces F4X and F5X of respective powers are checked for checking how the component forces F4X and F5X of the X component of the powers act on the development roller 241 during rotation, a result to meet the rotation angle θ(°) of the development roller 241 is obtained at a lower left section of FIG. 14. The tracking forces each appear as a result that changes to draw a sinusoidal curve waveform including a plus value and a minus value with a phase difference of 180° corresponding to the arrangement relationship of the two claws.

Then, when the respective tracking forces of the component forces F4X and F5X of the X component of the respective powers are added, the result shown in a lower right section in FIG. 14 is obtained.

That is, if the component forces F4X and F5X of the X component are added, the tracking force periodically changes at the plus side. Actually, a tracking force at the minus side may be provided due to a variation in component force and a variation in phase.

In the imaging unit 2 that employs the driving coupling member (or the driven coupling member) of the two claws, the total tracking force is transmitted from the coupling member to the development roller 241. Hence, the transmitted rotational power may vary. In this case, when the development roller 241 starts to be rotationally driven in the arrow B direction, it is expected that the acting force that causes the developing device 24 to swing in the direction P1 toward the photoconductor drum 21 finally becomes a variable and unstable force.

Other Exemplary Embodiments

In the first exemplary embodiment, the pivot portion 28 of the developing device 24 in the imaging unit 2 is arranged above the developing device 24 in the gravity direction; however, the pivot portion 28 may be arranged below the developing device 24 in the gravity direction (see FIG. 13). In the imaging unit 2, the coil spring 29 exemplified in the first exemplary embodiment may be omitted. Also, the developing device is not limited to the two-component developing device 24, and may be, for example, a one-component developing device that uses a one-component developer.

Also, in the first exemplary embodiment, the three claws 16*a* to 16*c* are provided as the coupling member including the driven-side coupling 60 and the driving-side coupling 15 in the imaging unit 2; however, four or more claws may be provided for the claws of the coupling member. Alternatively, the claws may be formed at the driven-side coupling 60. The shape etc. of the claws is not particularly limited.

Further, in the first exemplary embodiment, the four imaging units 2 (Y, M, C, K) are removably mounted as the image forming apparatus 1; however, plural imaging units 2 (by a number other than 4) or a single imaging unit 2 may be mounted in the image forming apparatus 1. That is, as long as the image forming apparatus 1 may be used while the imaging unit 2 is mounted, the conditions such as form etc. are not particularly limited.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An imaging unit, comprising:

a support body;

a photoconductor supported by the support body;

a developing device supported by the support body to be able to swing about a pivot arranged at a pivot portion, and including a development roller having a gap holding member that contacts a portion of the photoconductor and holds a gap between the development roller and the photoconductor; and a driven coupling member that is provided at a first end portion of the development roller, is coupled in a removably inserted manner to a driving coupling member to which a rotational power is transmitted, and transmits the rotational power to the development roller, wherein the pivot portion is arranged at a position at which the developing device swings in a direction toward the photoconductor by a self weight of the developing device, wherein the driving coupling member or the driven coupling member is a member in a form having at least three protruding portions that restrict movement of the developing device in a rotation direction when the driving coupling member and the driven coupling member are coupled, and wherein the development roller rotates in a direction in which an action that causes the developing device to swing in the direction toward the photoconductor is generated when the development roller receives the rotational power from the driving coupling member and is rotationally driven.

2. The imaging unit according to claim 1, wherein the pivot portion is arranged at a position at which a moment generated around the pivot acts in a direction in which the development roller contacts the photoconductor, with respect to a tangential vector directed in a rotation direction of the development roller at an intersection point far from the pivot included in intersection points at which a straight line connecting the pivot with a rotation center of the development roller intersects with a surface of the development roller.

3. An image forming apparatus, comprising:

the imaging unit according to claim 1; and the driving coupling member that is coupled in the removably inserted manner to the driven coupling member of the developing device in the imaging unit and transmits the rotational power to the development roller.

* * * * *